US008833708B2

(12) United States Patent
Droomer

(10) Patent No.: US 8,833,708 B2
(45) Date of Patent: Sep. 16, 2014

(54) SUPPORT STRUCTURE

(76) Inventor: Jack McKenzie Droomer, Anglesea (AU)

( * ) Notice: Subject to any disclaimer, the term of this patent is extended or adjusted under 35 U.S.C. 154(b) by 852 days.

(21) Appl. No.: 12/517,779

(22) PCT Filed: Dec. 6, 2007

(86) PCT No.: PCT/AU2007/001884

§ 371 (c)(1),
(2), (4) Date: Apr. 5, 2010

(87) PCT Pub. No.: WO2008/067608

PCT Pub. Date: Jun. 12, 2008

(65) Prior Publication Data

US 2010/0193531 A1 Aug. 5, 2010

(30) Foreign Application Priority Data

Dec. 6, 2006 (AU) ..... 2006906826

(51) Int. Cl.
*A45D 19/04* (2006.01)
*A47J 47/16* (2006.01)
*F16M 11/00* (2006.01)

(52) U.S. Cl.
USPC ..... 248/127; 248/188.1; 248/188.8; 248/188.91; 405/53; 405/59

(58) Field of Classification Search
USPC ..... 248/121, 161, 127, 188.1, 188.8, 248/188.91; 405/284, 286, 55, 52, 53, 59
See application file for complete search history.

(56) References Cited

U.S. PATENT DOCUMENTS

| | | | | |
|---|---|---|---|---|
| 3,913,335 | A * | 10/1975 | Heien | 405/210 |
| 4,558,544 | A * | 12/1985 | Albrecht et al. | 52/126.6 |
| 6,533,501 | B1 * | 3/2003 | Callinan et al. | 405/229 |
| 8,182,179 | B2 * | 5/2012 | Bohnhoff | 405/284 |

FOREIGN PATENT DOCUMENTS

| | | | |
|---|---|---|---|
| EP | 0 943 737 | A1 | 9/1999 |
| GB | 2 417 733 | B | 1/2008 |
| JP | 09111848 | A | 4/1997 |
| JP | 2006083555 | A | 3/2006 |
| JP | 2007138686 | A | 6/2007 |
| WO | 98/35106 | A1 | 8/1998 |

* cited by examiner

*Primary Examiner* — Amy J Sterling

(74) *Attorney, Agent, or Firm* — Seed IP Law Group PLLC

(57) ABSTRACT

A support structure for providing internal vertical support within an underground water storage system, including a column member, a foot spreader module adapted for fitting to a lower end of the column member to support the column member in a substantially vertical orientation on an underlying surface, and a head spreader module adapted for fitting to an upper end of the column member to support an overlying surface relative to said underlying surface, whereby the column member with said foot and head spreader modules fitted thereto forms a column support for supporting a ground surface above the water storage system.

16 Claims, 7 Drawing Sheets

SUPPORT STRUCTURE

BACKGROUND

1. Technical Field

This disclosure relates to a support structure for underground water storage and, more particularly, to a support structure for providing internal support within an underground storm water storage system.

2. Description of the Related Art

It is known to provide a series of stacked plastic modules to form an underground structure for storage of storm water. One such module of this kind forms the subject of Australian Patent No. 724,847. The plastic module disclosed in this document is able to be stacked with other like modules to form a structure having a volume which is mainly empty space (i.e., 94% void) capable of being filled with water. At the same time, the structure is strong enough to support an overlying ground surface which, in turn, can support, specifically, legally fully loaded transport vehicles.

However, the applicant has identified that the above module is relatively costly to manufacture, and is also over-engineered for some applications.

Embodiments of the present invention seek to provide an improved support structure for underground storage of water.

BRIEF SUMMARY

In accordance with one embodiment of the present invention, there is provided a support structure for providing internal vertical support within an underground water storage system, including a column member, a foot spreader module adapted for fitting to a lower end of the column member to support the column member in a substantially vertical orientation on an underlying surface, and a head spreader module adapted for fitting to an upper end of the column member to support an overlying surface relative to said underlying surface, whereby the column member with said foot and head spreader modules fitted thereto forms a column support for supporting a ground surface above the water storage system.

In some embodiments, the head spreader module and the foot spreader module are like units, with the unit of the head spreader module being inverted relative to the foot spreader module when fitted.

In some embodiments, the spreader modules are generally tapered outwardly to distribute load from the column member over an area greater than a cross-sectional area of the column member.

In some embodiments, the spreader modules are provided with reinforcing ribs or the like.

In some embodiments, the column member has reinforcing ribs or the like.

In accordance with another embodiment of the present invention, there is provided a unit for forming the foot and head spreader modules of the support structure described above, wherein the unit includes a seat portion adapted for seating with the underlying and overlying surfaces, and a coupling portion adapted for fitting to the column member, wherein the unit has ribs extending outwardly from the coupling portion to the seat portion for distributing load from the column member.

Preferably, in some embodiments, the unit is integrally formed as a single piece. More preferably, the unit is formed of plastic. Even more preferably, the unit is formed of polypropylene. Alternatively, in some embodiments, the unit is formed of polyethylene terephthalate (PET).

In accordance with another embodiment of the present invention, there is provided a method of forming a support structure for providing internal vertical support within an underground water storage system, of the method comprising:

providing a column member;

fitting an outwardly tapered foot spreader module to a lower end of the column member to distribute load from the column member to an underlying surface beneath the foot spreader module across a load transfer area greater than a cross-sectional area of the column member; and fitting an outwardly tapered head spreader module to an upper end of the column member to distribute support from the column member to an overlying surface above the head spreader module across a load transfer area greater than a cross-sectional area of the column member, whereby the column member with said foot and head spreader modules fitted thereto forms a column support for supporting a ground surface above the water storage system.

In some embodiments, the method further includes cutting the column member to a length to suit site-specific criteria.

In some embodiments, the method further includes securing the foot spreader module to a lower unit forming the underlying surface. In some embodiments, the method further includes securing the head spreader module to an upper unit forming the overlying surface. In some embodiments, the securing is achieved by way of a clip having a barbed end for connecting to an aperture in the spreader module, and a hooked end for hooking around an element of the upper and/or lower unit.

In accordance with another embodiment of the present invention, there is provided a support system including at least one support structure as described above, adjacent at least one support unit, wherein the support unit is capable of supporting load and has a void capable of being filled with water.

In some embodiments, the support unit is formed of a plurality of modular layer units. In some embodiments, the support system includes a three-dimensional grid formation having an outside perimeter region formed of a plurality of support units laid in side-by-side arrangement and an inner region within the outside perimeter region formed of a plurality of support structures laid in a side-by-side arrangement.

In some embodiments, the support system includes an upper layer formed of the modular layer units on top of the three-dimensional grid formation, and a lower layer formed of the modular layer units below the three-dimensional grid formation. In some embodiments, the upper and lower layers are arranged such that each of the support units has above and below an additional modular layer unit, and each of the support structures has above and below a modular layer unit forming said overlying and underlying surfaces.

In some embodiments, the support system includes a further upper layer on top of said upper layer, the further upper layer including modular layer units horizontally offset relative to the modular layer units of said upper layer. Similarly, in some embodiments, the support system includes a further lower layer below said lower layer, the further lower layer including modular layer units horizontally offset relative to the modular layer units of said lower layer. The support system may include one or more additional layers of modular layer units above the further upper layer and/or below the further lower layer.

BRIEF DESCRIPTION OF THE SEVERAL VIEWS OF THE DRAWINGS

Embodiments of the invention are described, by way of non-limiting examples only, with reference to the accompanying drawings in which.

DETAILED DESCRIPTION

Figure 1:
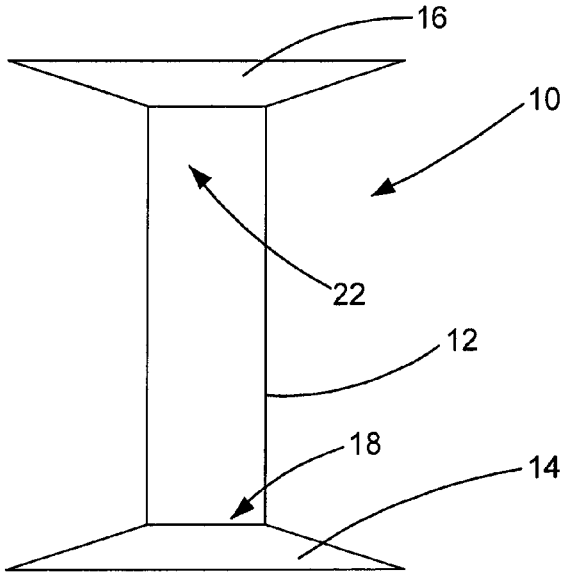
FIG. 1 is a diagrammatic side view of a support structure in accordance with an embodiment of the present invention.
Figure 2:
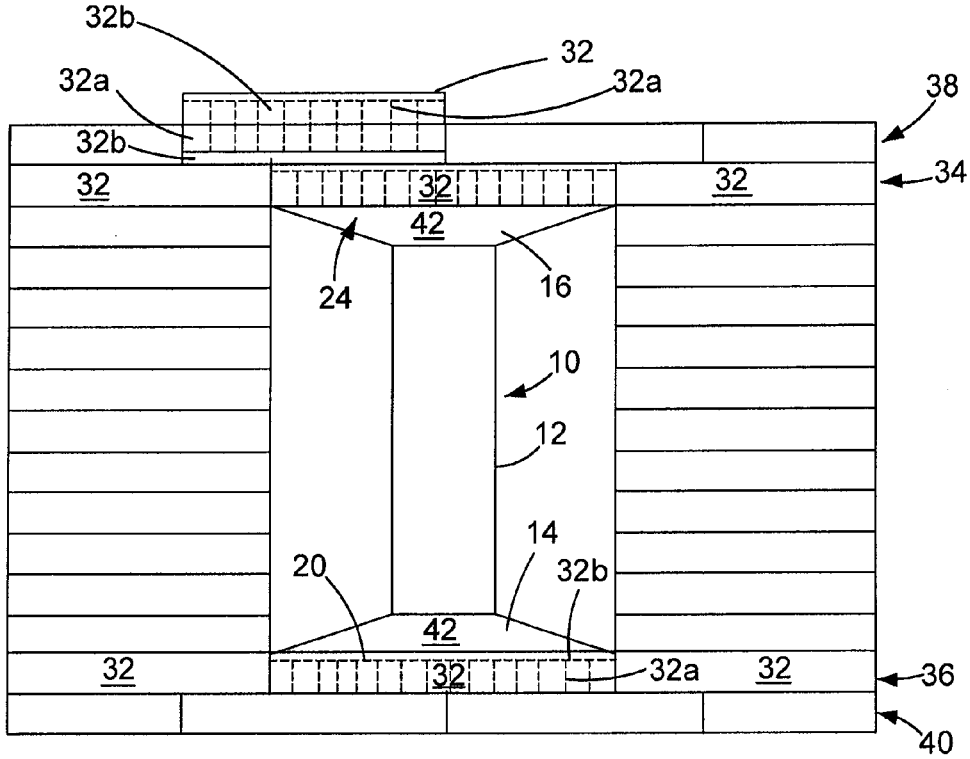
FIG. 2 is a diagrammatic side view of the support structure of FIG. 1, shown in an arrangement amongst layers of stormwater storage layer modules of an existing type.

With reference to FIGS. 1 and 2, a support structure 10 is provided for internal vertical support within an underground water storage system. The support structure 10 includes a column member 12, a foot spreader module 14 and a head spreader module 16. The foot spreader module 14 is adapted for fitting to a lower end 18 of the column member 12 to support the column member 12 in a substantially vertical orientation on an underlying surface 20. The head spreader module 16 is adapted for fitting to an upper end 22 of the column member 12 to support an overlying surface 24 relative to the underlying surface 20. The column member 12 with the foot and head spreader modules 14, 16 fitted thereto forms a column support for supporting a ground surface above the water storage system, such that, for example, roads, car parks, sporting fields, parks and some small building structures can be supported above the water storage system.

The head spreader module 16 and the foot spreader module 14 are like units 42, with the unit 42 of the head spreader module 16 being inverted relative to the foot spreader module 14 when fitted. The head and foot spreader modules 16, 14 are generally tapered outwardly to distribute load from the column member 12 over an area greater than a cross-sectional area of the column member 12. Accordingly, the spreader modules 16, 14 increase the stability and load carrying capacity of the column member 12 which may be formed from a plastic pipe by cutting the plastic pipe to length to suit site-specific criteria. In one embodiment, the pipe used is 300 mm diameter PVC stormwater pipe having 12 mm wall thickness. In an alternative embodiment, the column member 12 may have reinforcing ribs such as, for example, radially spaced internal fin-like ribs running along the length of the member 12 to further increase its load carrying capacity and lateral stability.

Figure 3:
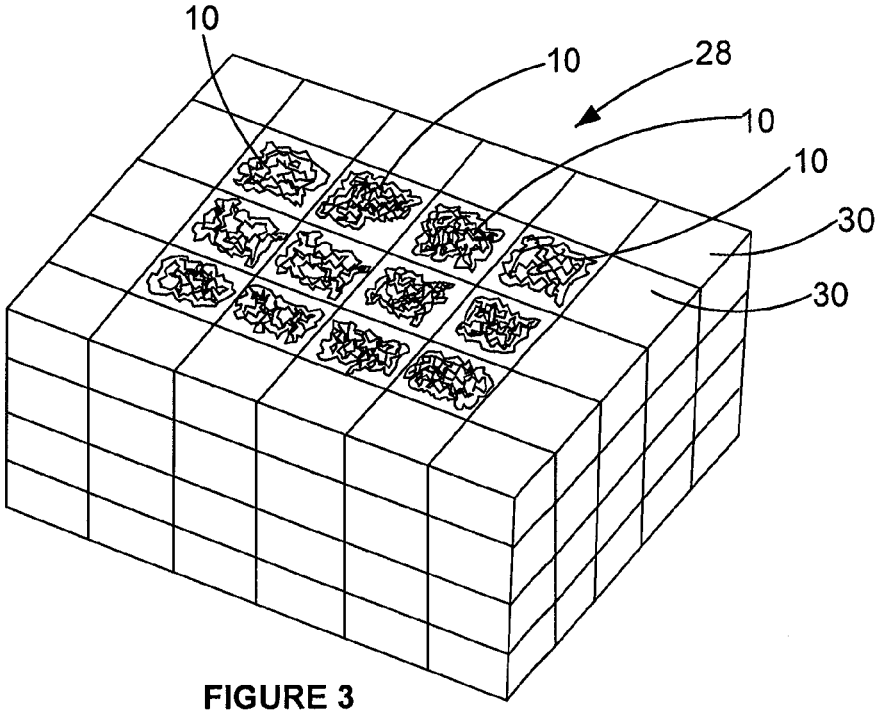
FIG. 3 is a diagrammatic perspective view of a support system for underground water storage including a plurality of support structures of the kind shown in FIGS. 1 and 2.

FIG. 3 shows diagrammatically a support system 28 including a plurality of support structures 10 arranged together in a 3×4 grid-like inner region within a perimeter region of support units 30. The support units 30 are arranged in a side-by-side 5×6 formation to surround the grid-like formation of the support structures 10. Each of the support units 30 is capable of supporting load and has a void capable of being filled with water, and may be in the form of a stack of modular storm water storage layer units 32 of an existing kind, such as the kind referred to as "Rainstore[3]" disclosed in Australian Patent No. 724,847, or any other suitable storage layer unit which may be of the kind disclosed in U.S. Pat. No. 7,080,480.

As the support structures 10 use less material than the support units 30, the support system 28 shown in FIG. 3 uses less material and has a greater capacity for storing water than if it were formed with only support units 30.

A support system 28 formed in accordance with the embodiment shown in FIG. 3 may also include an upper layer 34 formed of like modular layer units 32 arranged on top of the perimeter and inner regions, and a lower layer 36 formed of like modular layer units 32 below the perimeter and inner regions (see FIG. 2). The upper and lower layers 34, 36 are arranged such that each of the support units 30 has above and below an additional modular layer unit 32, and each of the support structures 10 has above and below a modular layer unit 32 forming said overlying and underlying surfaces 24, 20.

The support system 28 may also include a further upper layer 38 on top of the upper layer 34, the further upper layer 38 including like modular layer units 32 horizontally offset relative to the modular layer units 32 of the upper layer 34, so as to increase strength of the support system. Similarly, the support system 28 may also include a further lower layer 40 below the lower layer 36, the further lower layer 40 including like modular layer units 32 horizontally offset relative to the modular layer units 32 of the lower layer 36. The offsetting of the modular layer units 32 of the further upper layer 38 and the further lower layer 40 may be half the side length of a singular modular layer unit 32, and may be in both orthogonal directions within the plane of the layers 38, 40. In one particular embodiment, the modular layer units 32 are 1000 mm×1000 mm×10 mm, and the offset is 500 mm.

Yet a further layer of modular layer units 32 may be provided above and connected to the further upper layer 38 by means of multiple joining plastic pipe sleeves 32*a* of the modular layer units 32 (see FIG. 2). Each modular layer unit 32 also has a frame 32*b* which interconnects the pipe sleeves 32*a* of that unit 32. The modular layer units 32 of the upper layer 34 may be oriented such that the plastic pipe sleeves 32*a* of those units 32 extend downwardly from the frames 32*b* of the modular layer units 32; the modular layer units 32 of the further upper layer 38 may be oriented such that the plastic pipe sleeves 32*a* of those units 32 extend upwardly from the frames 32*b* of the modular layer units 32, and modular layer units 32 of the further layer may be oriented such that the plastic pipe sleeves 32*a* of those units 32 extend downwardly from the frames 32*b* of the modular layer units 32. In this way a suitable surface for walking on during installation of the support system 28 is provided by the frames 32*b* of the modular layer units 32 of the further layer.

Figure 4:
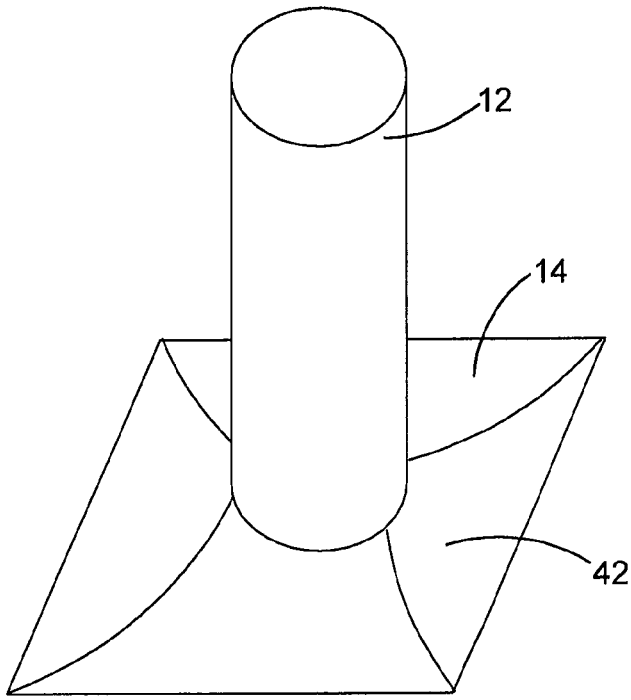
FIG. 4 is a diagrammatic perspective view of a column member and a foot spreader module of the support structure shown in FIGS. 1 and 2.
Figure 5:
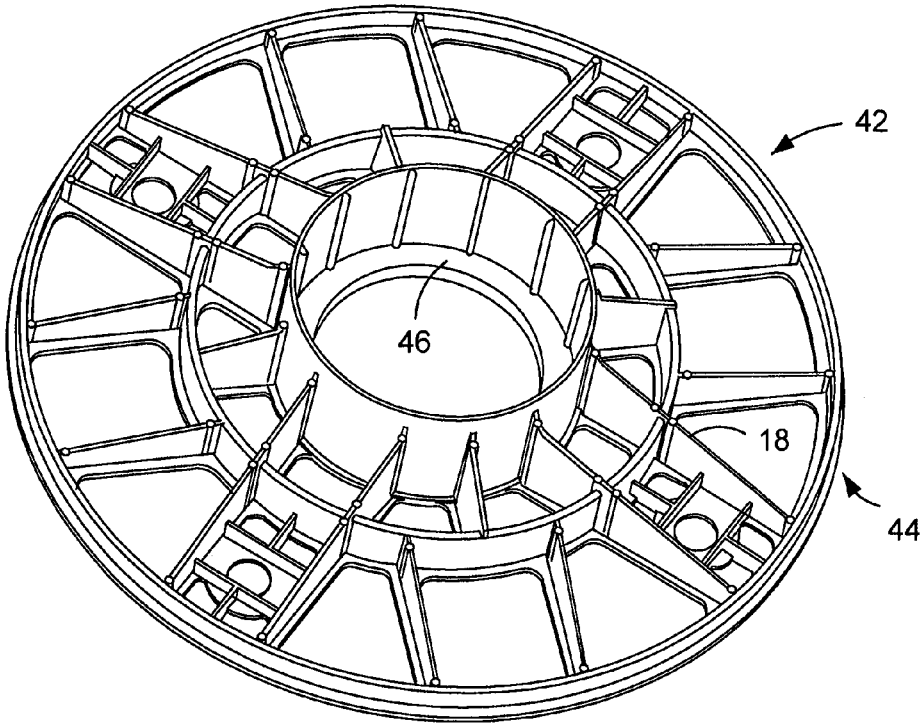
FIG. 5 is a perspective view of a spreader module in accordance with another embodiment of the present invention.

Referring now to the support structure 10 in more detail, the head and foot spreader modules 16, 14 may be formed, for example, by using a unit 42 having a square base as shown in FIG. 4, or by using a unit 42 having a round base as shown in FIG. 5.

The unit 42 of FIG. 5 includes a substantially planar circular seat portion 44 adapted for seating on the underlying surface 20 and overlying surface 24, and a coupling portion 46 adapted for fitting to the column member 12. The coupling portion 46 is in the form of a sleeve sized to fit around an end of the column member 12, and has a rim for abutting against an end of the column member 12. The unit 42 has ribs 48 extending outwardly from the coupling portion 46 to the seat portion 44 for distributing load from the column member 12.

The unit may be integrally formed as a single piece, injection moulded in plastic. The type of plastic used may be, for example, polypropylene or polyethylene terephthalate (PET). Polypropylene has the advantages of being easy to mould, strong and readily available. PET has the advantages of being highly rigid, very strong and even more readily available than polypropylene, but it is more difficult to work with.

Figure 6:
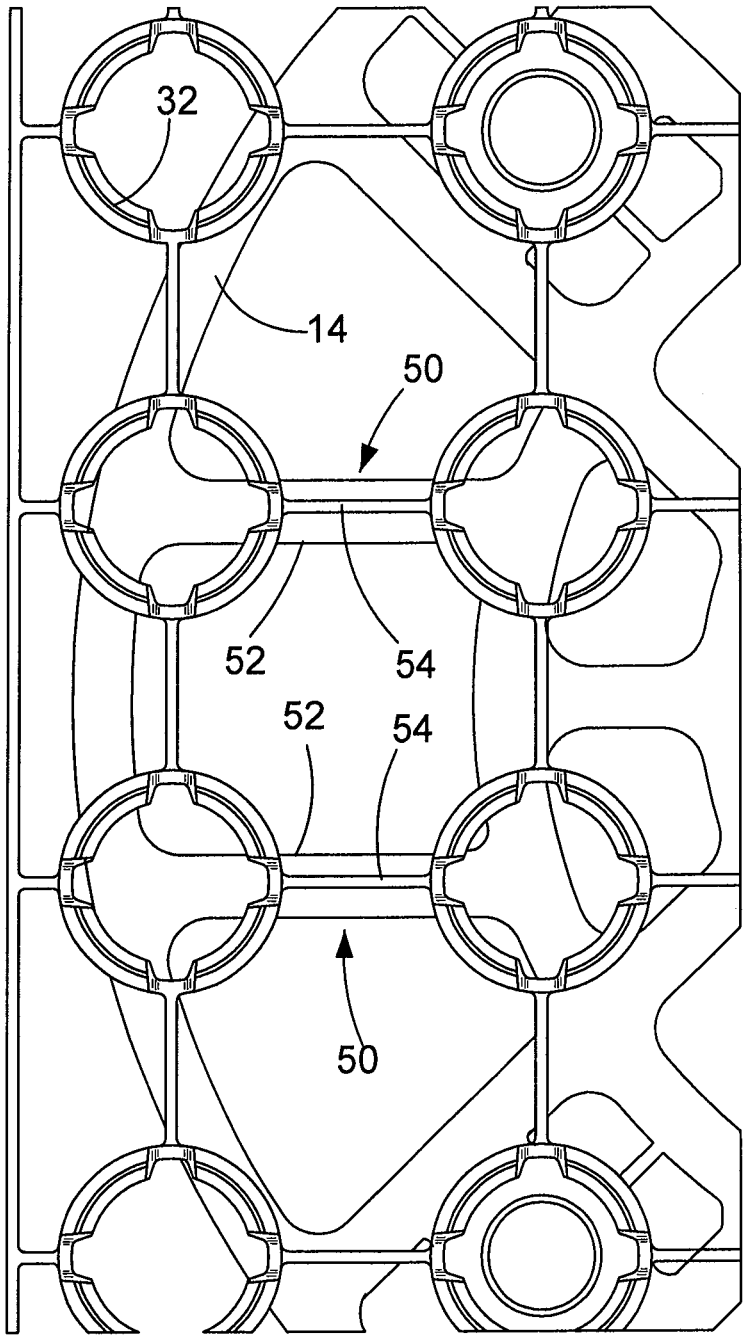
FIG. 6 is an underside detailed view showing part of the spreader module of FIG. 5 supported on a stormwater storage layer module.
Figure 7:
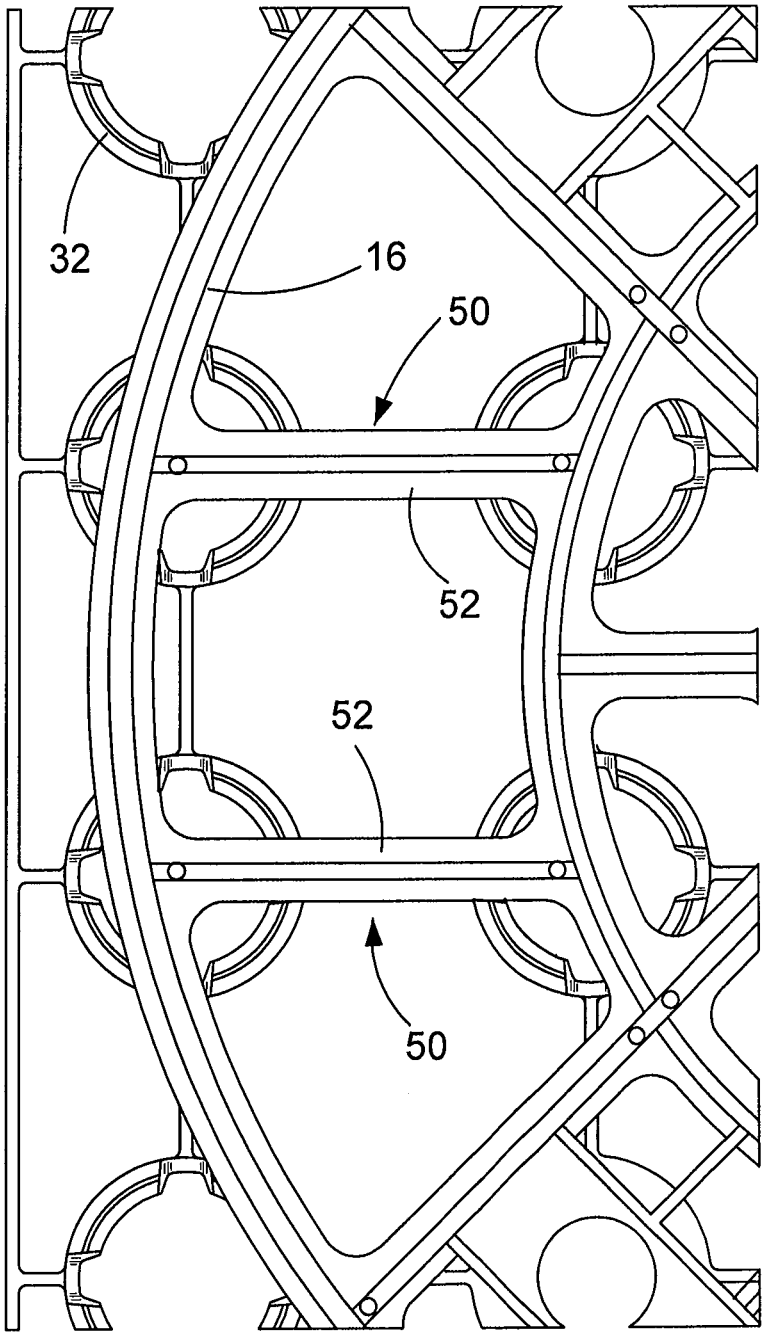
FIG. 7 is a top view of the arrangement shown in FIG. 6.

Mounting of the support structure 10 relative to the neighbouring storage layer unit 32 may include securing the foot spreader module 14 to a lower storage layer unit 32 forming the underlying surface 20, and securing the head spreader module 16 to an upper storage layer unit 32 forming the overlying surface 24. The parts may be secured at locations where ribs 52 of the spreader modules 14, 16 are aligned with an adjacent framework 54 of the frame 32*b* of the adjacent storage layer unit 32. Examples of such locations are identified by reference numeral 50 in FIGS. 6 and 7 which show, respectively, bottom and top views of the foot spreader module 14 and head spreader module 16 against the lower and upper storage layer units 32.

Figure 8:
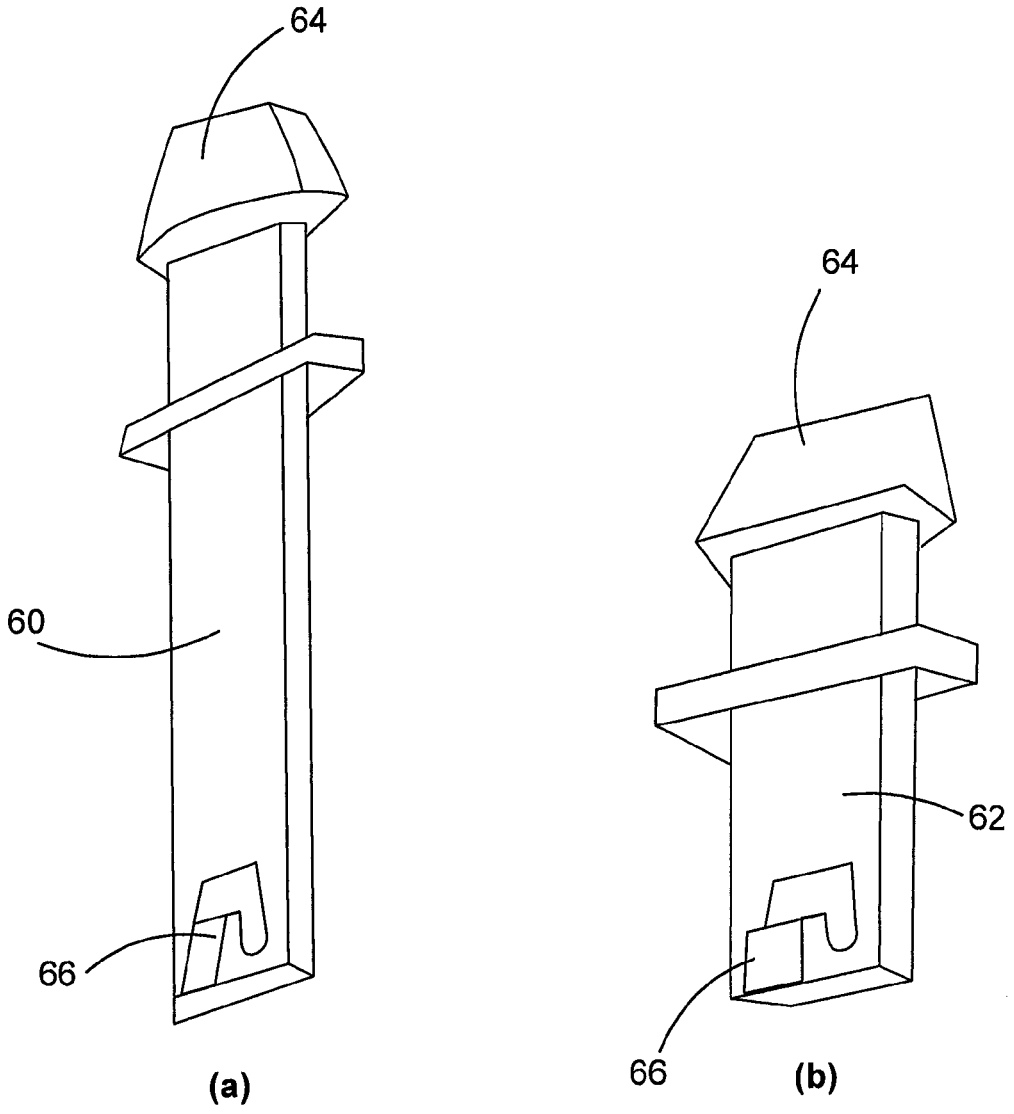
FIG. 8 is a diagrammatic perspective view showing a pair of clips for securing a spreader module to a stormwater storage layer module.

Clips 60, 62 of the kind shown in FIGS. 8(*a*) and 8(*b*) may be used for the securing of the spreader modules 14, 16 to the adjacent storage layer units 32 in this way. The longer clip 60 shown in FIG. 8(*a*) may be used where a larger separation exists between the ribs 52 of the head spreader module 16 and the framework 54 of the adjacent storage layer unit 32. In practice, owing to the positioning of the framework 54 within the storage layer units 32, the longer clip 60 will be used for the head spreader module 16 (see FIG. 7), and the shorter clip 62 will be used for the foot spreader module 14 (see FIG. 6).

By virtue of the geometry of the spreader modules 14, 16, and specifically the presence of eight ribs 52 which align with corresponding framework of an adjacent storage layer unit 32, up to eight (and preferably at least two) clips 60, 62 are used for each spreader module 14, 16.

With reference to the clips themselves, each clip 60, 62 has a barbed end 64 for connecting to an aperture to be formed in a rib 52 of the spreader module 14, 16, and a hooked end 66 for hooking around an adjacent framework element 54 of the upper and/or lower storage layer unit.

Figure 9:
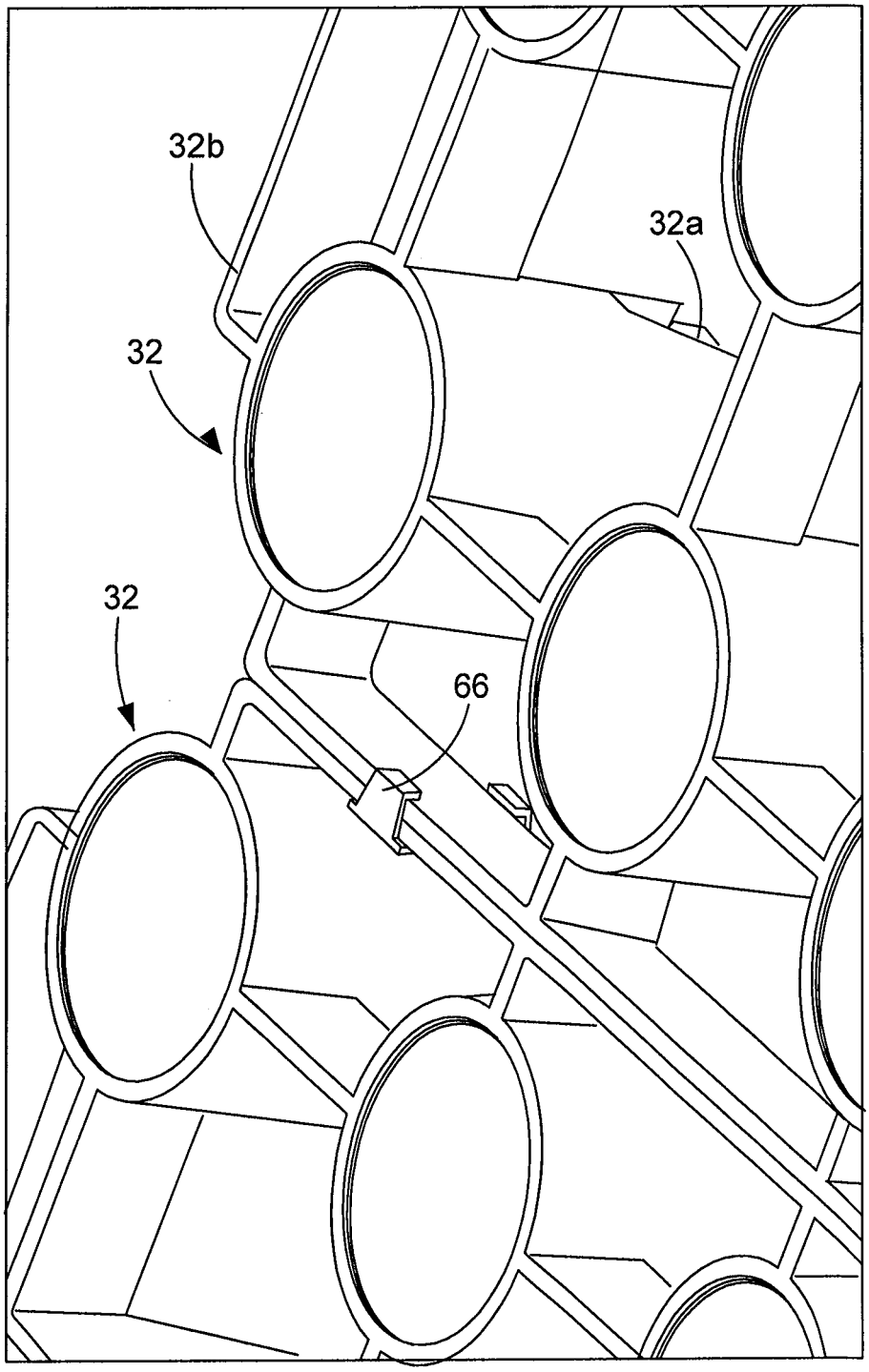
FIG. 9 is a detailed perspective view showing a pair of stormwater storage layer modules coupled with a clip.

FIG. 9 shows a pair of adjacent storage layer units 32 coupled together by a clip 68 which is hooked at both ends. The storage layer units 32 may be coupled together in this manner to stabilise the support system 28 during construction.

The above support structure, and support system including the support structure, have been described by way of example only and modifications are possible within the scope of the invention.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The claims defining the invention are as follows:

1. An underground water storage container for storing stormwater drainage, wherein:

the underground water storage container is buried below a ground surface, and the underground water storage container comprises a support structure located internally of the underground water storage container for providing internal vertical support to the underground water storage container and vertical support to the ground surface above the underground water storage container, the support structure comprising:

a hollow column member configured to be filled with water to increase the underground water storage container capacity;

a foot spreader module adapted for fitting to a lower end of the hollow column member to support the hollow column member in a substantially vertical orientation on an underlying surface; and a head spreader module adapted for fitting to an upper end of the hollow column member to support an overlying surface relative to said underlying surface, whereby the hollow column member with said foot and head spreader modules fitted thereto defines a column support for providing said internal vertical support to the underground water storage container, wherein the head spreader module and the foot spreader module are each formed of a modular unit common to both spreader modules, and the hollow column member is a load bearing member which vertically supports the head spreader module in spaced relationship to the foot spreader module, and wherein the modular unit is tapered outwardly to distribute load from the hollow column member over an area greater than a cross-sectional area of the hollow column member.

2. The underground water storage container of claim 1, wherein the head spreader module and the foot spreader module are identical common units, with the unit of the head spreader module being inverted relative to the unit of the foot spreader module when fitted.

3. The underground water storage container of claim 1, wherein the spreader modules are provided with reinforcing ribs.

4. The underground water storage container of claim 1, wherein the hollow column member has reinforcing ribs.

5. The underground water storage container of claim 1 wherein the foot spreader module and the header spreader module are each formed as a spreader module comprising:

a seat portion adapted for abutting the underlying surface or the overlying surface;

a coupling portion adapted for fitting to the hollow column member of the support structure; and ribs extending outwardly from the coupling portion to the seat portion for distributing load from the hollow column member.

6. The underground water storage container of claim 5, wherein the spreader module is integrally formed as a single piece.

7. The underground water storage container of claim 6, wherein the spreader module is formed of plastic.

8. The underground water storage container The support structure of claim 7, wherein the spreader module is formed of polypropylene.

9. The underground water storage container of claim 7, wherein the spreader module is formed of polyethylene terephthalate.

10. The underground water storage container of claim 1, further comprising:

at least one support unit adjacent the support structure, wherein the support unit is configured to support load and has a void capable of being filled with water.

11. The underground water storage container of claim 10, wherein the support unit includes a plurality of modular layer units.

12. The underground water storage container of claim 11, wherein the underground water storage container includes a three-dimensional grid formation having an outside perimeter region comprising a plurality of support units laid in side-by-side arrangement and an inner region within the outside perimeter region comprising a plurality of support structures laid in side-by-side arrangement.

13. The underground water storage container of claim 12, further comprising:

an upper layer including a plurality of modular layer units on top of the three-dimensional grid formation; and a lower layer including a plurality of modular layer units below the three-dimensional grid formation.

14. The underground water storage container of claim 13, wherein the upper and lower layers are arranged such that each of the support units has at either end above and below the support unit a single additional modular layer unit, and each of the support structures has at either end above and below the support structure a single modular layer unit forming said overlying surface and said underlying surface.

15. The underground water storage container of claim 14, further comprising:

a further upper layer on top of said upper layer, the further upper layer including modular layer units horizontally offset relative to the modular layer units of said upper layer.

16. The underground water storage container of claim 15, further comprising:

a further lower layer below said lower layer, the further lower layer including modular layer units horizontally offset relative to the modular layer units of said lower layer.

* * * * *